US005586362A

United States Patent [19]

Baker

[11] Patent Number: 5,586,362

[45] Date of Patent: Dec. 24, 1996

[54] ANTI-RUBBING BLOCK

[75] Inventor: Neil M. Baker, Barnwood, United Kingdom

[73] Assignee: Securistyle Limited, Cheltenham, United Kingdom

[21] Appl. No.: 357,857

[22] Filed: Dec. 15, 1994

[30] Foreign Application Priority Data

Apr. 14, 1994 [GB] United Kingdom ..... 9407370

[51] Int. Cl.[6] ..... E05D 13/00

[52] U.S. Cl. ..... 16/193; 49/181

[58] Field of Search ..... 16/193, 348, 360, 16/361, 363, 368, 369, 370, 371; 49/181, 182, 248, 249, 250, 251, 252, 445, 446

[56] References Cited

U.S. PATENT DOCUMENTS 2,932,848 4/1960 Ahlgren ..... 49/251

4,980,947 1/1991 McQuigge ..... 16/235

FOREIGN PATENT DOCUMENTS 2101199 1/1983 United Kingdom .
2162892 2/1986 United Kingdom .
2246163 1/1992 United Kingdom .
2258267 2/1993 United Kingdom .

*Primary Examiner*—Chuck Y. Mah
*Attorney, Agent, or Firm*—Greenlee, Winner and Sullivan, P.C.

[57] ABSTRACT

An anti-rubbing block 9 for a friction stay, comprising a body 11 for positioning within a track 1 of a friction stay, the body 11 extending above the track 1 to prevent rubbing of a link 5 of the stay on the track 1, and a flange 13 extending from the body 11 substantially parallel to the track 1, during use, for attachment to a slider 3 of the stay such that the anti-rubbing block 9 moves with the slider 3 along the track 1 during opening and closing of the stay. Such an anti-rubbing block 9 assists in avoiding unnecessary wear and tear, especially when the slider 3 has a metal surface.

31 Claims, 1 Drawing Sheet

ANTI-RUBBING BLOCK

Figure 1:
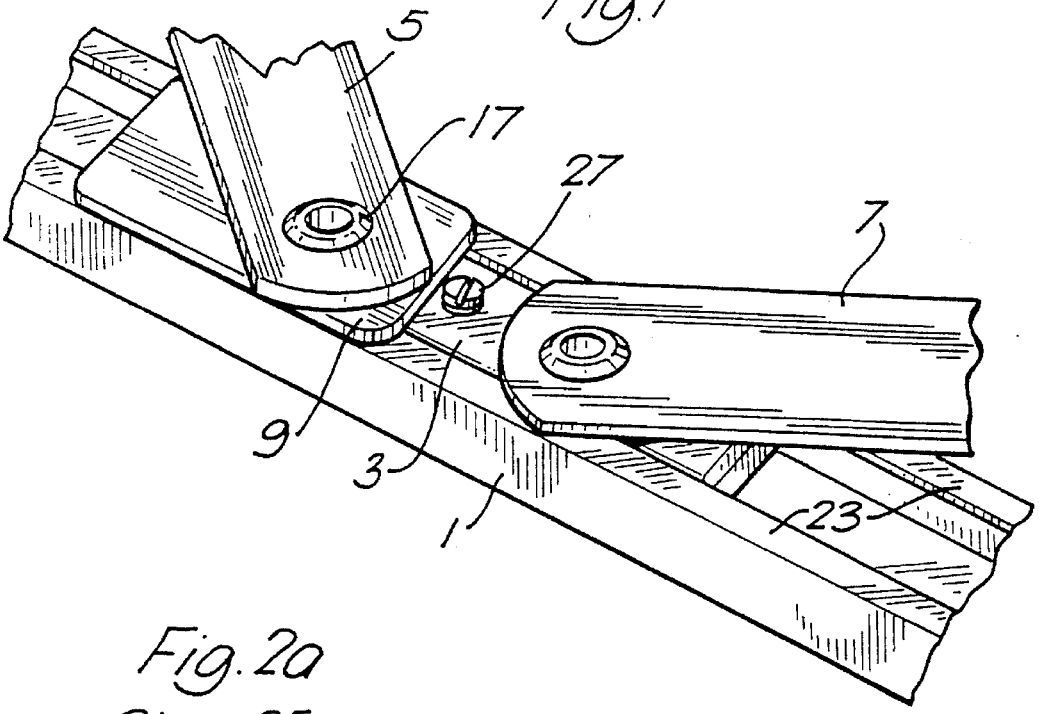
Figure 2A:
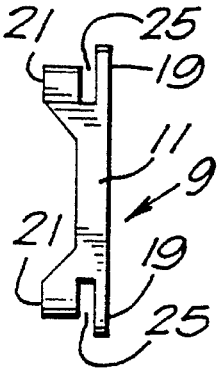
Figure 2B:
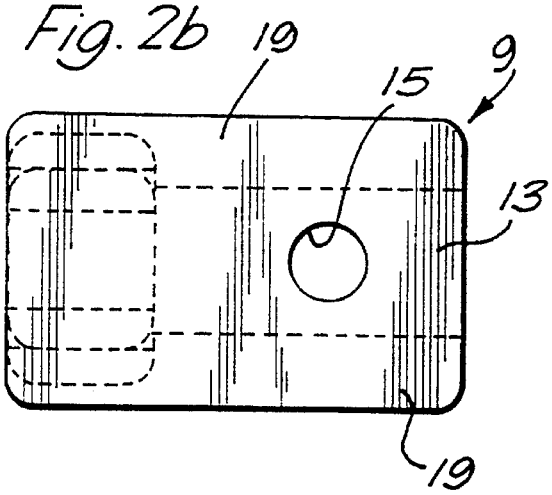
Figure 2C:
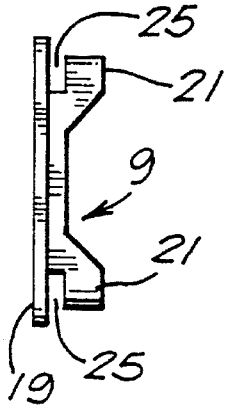
Figure 2D:
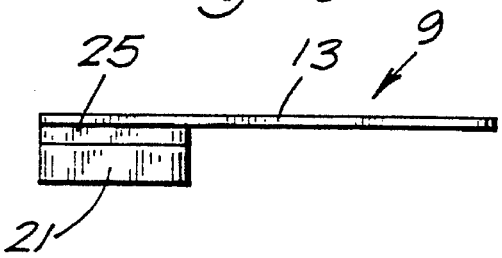

This invention relates to frictions stays, and in particular to an anti-rubbing block for a friction stay.

Friction stays are well known which incorporate a support track, a slider mounted in the support track for movement along the support track, a vent arm for attachment to a window or the like and a plurality of links joining the vent arm to the support track and the slider. One form of such friction stay is known as a quadrilateral linkage friction stay.

In certain markets, notably the United States of America, users of friction stays take the view that a slider manufactured from metal is stronger than a slider manufactured from plastics material. Accordingly, in some circumstances it is preferable to manufacture and sell friction stays incorporating metal sliders.

Unfortunately, if a slider has an exposed metal surface, the surface can cause unwanted rubbing as a link of the friction stay moves from a closed position overlying the track to an open position angled with respect to the track. This can be a particular problem in "loose rivet" friction stays. As a result, excessive wear can occur which is clearly undesirable. It is known, therefore, to include a plastics washer between a slider and a link attached to the slider via a rivet or the like.

Although the use of a plastics washer is an improvement, such washers are often destroyed through use duets the fact that the washer is forced to turn as the friction stay opens or closes. Tearing of the plastics washer can result.

The present invention has been devised to overcome the problems associated with the prior art arrangements by providing an anti-rubbing block which is far stronger and more reliable than the plastics washers known in the prior art.

According to the present invention, there is provided an anti-rubbing block for a friction stay, comprising a body for positioning within a track of a friction stay, the body extending above the track to prevent rubbing of a link of the stay on the track, and a flange extending from the body substantially parallel to the track, during use, for attachment to a slider of the stay such that the anti-rubbing block moves with the slider along the track during opening and closing of the stay.

Preferably the flange includes an aperture for receiving a rivet attaching a link to the slider of the stay. Alternative ways of attaching the anti-rubbing block to a slider of a friction stay could also be used.

Preferably the body includes lips for overlying the edges of the side walls of the track. By including such lips, the metal track can be hidden completely from the link adjacent the anti-rubbing block.

The block preferably further comprises means for supporting the body within the track. As a result, if pressure is applied to the body by means of a link abutting the body, the body can be held in an active position protecting the surfaces of the slider and the support track.

In one embodiment, the support means comprise legs for abutting the sides and bottom of the track. The legs may define a clearance channel to prevent clashing of the block with screw heads within the track, during sliding of the block along the track.

Preferably the legs and lips define grooves for receiving flanges extending inwardly from the tops of the side walls of the track. As a result, the anti-rubbing block will be held more securely in position within the track of the friction stay.

A block according to the present invention is preferably manufactured from acetal, which is preferably translucent.

Preferably the block acts, during use, between the track of a friction stay and a link joining the slider directly to the vent arm of the stay.

As mentioned previously, if an anti-rubbing block according to the present invention is to be used, the slider is likely to be manufactured at least partially from metal. The anti-rubbing block could, however, be used in other embodiments, if desired.

A specific embodiment of the present invention is now described, by way of example only, with reference to the accompanying drawings, in which:

FIG. 1 is a perspective view of a part of a friction stay incorporating an anti-rubbing block according to the present invention; and FIGS. 2*a*–2*d* show a front view, a plan view, a rear view and a side view of an anti-rubbing block according to the present invention.

With reference to the drawings, a friction stay, such as a quadrilateral linkage friction stay, comprises a support track 1, a slider 3 mounted in the support track 1 and a plurality of links 5, 7, not all of which are shown in the drawings, for attaching a vent arm (not shown) to the slider 3 and support track 1. As the vent arm moves from a position overlying the track 1 to a position angled to the track 1, the slider 3 moves along the track 1.

Although not essential, the slider 3 may be manufactured at least partially from metal. To prevent the link 5 from rubbing against the track 1 and/or the metal slider 3, an anti-rubbing block 9 according to the present invention is included in the friction stay. The anti-rubbing block 9 can be best seen in FIG. 2.

As can be seen in FIGS. 2*a*–2*d*, the anti-rubbing block 9 includes a body 11 for positioning within the support track 1 and a flange 13 extending from the body 11 substantially parallel to the track 1 to overlie the slider 3. The flange 13 includes an aperture 15 through which a rivet 17 attaching the first link 5 to the slider 3 passes. The block 9 is thereby permanently attached to the slider 3 for movement with the slider 3 along the support track 1.

Lips 19 extend outwardly from the body 11 of the block 9 to overlie the edges of the walls of the support track 1, thereby preventing any chance of the first link 5 rubbing against the support track 1. The anti-rubbing block 9 also includes legs 21 shaped to be received between inwardly extending flanges 23 of the support track 1 and the base of the support track 1. As a result, grooves 25 are formed in the block 9 between the lips 19 and the legs 21 for accommodating the inwardly extending flanges 23 of the support track 1. The block 9 is thereby held solidly and securely in position for sliding movement along the support track 1 as the slider 3 moves.

By reducing the friction between the first link 5 and the support track 1 and/or slider 3, the friction stay can be opened more freely. As a result, geometry lock-up of the links (which can result in an end point of the vent arm clashing with an end cap mounted on the end of the support track 1) is less likely to occur, even when heavy vents or windows are mounted on the friction stay.

As will be appreciated, in use the support track 1 is screwed or otherwise fixed to a frame of an opening to be closed by a vent mounted on the vent arm of the friction stay. Thus, screw heads may be exposed in the bottom of the support track 1. To avoid any clash between the anti-rubbing block 9 and such screw heads, the legs 21 define a clearance channel therebetween parallel to the axis of the support track 1.

Finally, although the slider 3 is manufactured primarily from metal, a friction pad (not shown) may be accommodated between the slider 3 and the bottom of the support track 1. The friction to be achieved between the slider 3 and the support track 1 may be varied by means of a grub screw 27 bearing against the friction pad. This is well known in the art.

It will of course be understood that the present invention has been described above purely by way of example, and that modifications of detail can be made within the scope of the invention.

I claim:

1. An anti-rubbing block for a friction stay, said stay including a track having sidewalls with edges, a slider mounted in the track, and a link connected to the slider and adapted to be connected to a vent arm, said anti-rubbing block comprising:

a body for positioning within the track, said body extending above the track to prevent rubbing of the link on the track;

said body having extending lips for overlying the edges of the side walls of the track; and said body having a flange extending from the body substantially parallel to the track, during use, for attachment to the slider such that the anti-rubbing block moves with the slider along the track during opening and closing of the stay.

2. A block as claimed in claim 1, wherein the flange includes an aperture for receiving a rivet attaching the link to the slider of the stay.

3. A block as claimed in claim 1, further comprising means for supporting the body within the track.

4. A block as claimed in claim 3, which is manufactured from translucent acetal.

5. A friction stay comprising a track, a slider mounted in the track, and a link connected to the slider and adapted to be connected to a vent arm, the stay further comprising an anti-rubbing block according to claim 3.

6. A friction stay as claimed in claim 5, wherein the slider includes means for adjusting friction between the slider and the track.

7. A friction stay as claimed in claim 5, wherein the slider is manufactured at least partially from metal.

8. A block as claimed in claim 3, wherein the support means comprise legs for abutting the sides and bottom of the track.

9. A block as claimed in claim 5, wherein the body includes lips for overlying the edges of the side walls of the track, and wherein the legs and lips define grooves for receiving flanges extending inwardly from the tops of the side walls of a track.

10. A block as claimed in claim 9, which is manufactured from translucent acetal.

11. A block as claimed in claim 8, which is manufactured from translucent acetal.

12. A block as claimed in claim 8, wherein the legs define a clearance channel to prevent clashing of the block with screw heads within a track, during sliding of the block along the track.

13. A block as claimed in claim 12, which is manufactured from translucent acetal.

14. A block as claimed in claim 12, wherein the legs and lips define grooves for receiving flanges extending inwardly from the tops of the side walls of a track.

15. A block as claimed in claim 14, which is manufactured from translucent acetal.

16. A block as claimed in claim 1, which is manufactured from translucent acetal.

17. A friction stay comprising a track, a slider mounted in the track, and a link connected to the slider and adapted to be connected to a vent arm, the stay further comprising an anti-rubbing block according to claim 1.

18. A friction stay as claimed in claim 17, wherein the slider is manufactured at least partially from metal.

19. A friction stay as claimed in claim 17, wherein the slider includes means for adjusting friction between the slider and the track.

20. A friction stay comprising a track, a slider mounted in the track, and a link connected to the slider and adapted to be connected to a vent arm, the stay further comprising an anti-rubbing block according to claim 8.

21. A friction stay as claimed in claim 20, wherein the slider includes means for adjusting friction between the slider and the track.

22. A friction stay as claimed in claim 20, wherein the slider is manufactured at least partially from metal.

23. A friction stay comprising a track, a slider mounted in the track, and a link connected to the slider and adapted to be connected to a vent arm, the stay further comprising an anti-rubbing block according to claim 12.

24. A friction stay as claimed in claim 23, wherein the slider includes means for adjusting friction between the slider and the track.

25. A friction stay as claimed in claim 23, wherein the slider is manufactured at least partially from metal.

26. A friction stay comprising a track, a slider mounted in the track, and a link connected to the slider and adapted to be connected to a vent arm, the stay further comprising an anti-rubbing block according to claim 9.

27. A friction stay as claimed in claim 26, wherein the slider includes means for adjusting friction between the slider and the track.

28. A friction stay as claimed in claim 26, wherein the slider is manufactured at least partially from metal.

29. A friction stay comprising a track, a slider mounted in the track, and a link connected to the slider and adapted to be connected to a vent arm, the stay further comprising an anti-rubbing block according to claim 14.

30. A friction stay as claimed claim 29, wherein the slider includes means for adjusting friction between the slider and the track.

31. A friction stay as claimed in claim 29, wherein the slider is manufactured at least partially from metal.

* * * * *

UNITED STATES PATENT AND TRADEMARK OFFICE

CERTIFICATE OF CORRECTION

PATENT NO. : 5,586,362

DATED : Dec. 24, 1996

INVENTOR(S) : Neil M. Baker

It is certified that error appears in the above-indentified patent and that said Letters Patent is hereby corrected as shown below:

column 1, line 27, delete "duets" and substitute --due to-- therefor.

In Claim 9, line 1, delete "5" and substitute --8-- therefor.

Signed and Sealed this

First Day of April, 1997

Bruce Lehman

*Attest:*

BRUCE LEHMAN

*Attesting Officer*

*Commissioner of Patents and Trademarks*